US007518299B2

(12) United States Patent
Kling

(10) Patent No.: US 7,518,299 B2
(45) Date of Patent: Apr. 14, 2009

(54) COMPACT PAR LAMP COMPRISING AN ELLIPSOID REFLECTOR HAVING MORE THAN ONE FOCAL POINT

(75) Inventor: Michael R. Kling, Lexington, KY (US)

(73) Assignee: OSRAM Sylvania Inc., Danvers, MA (US)

( * ) Notice: Subject to any disclaimer, the term of this patent is extended or adjusted under 35 U.S.C. 154(b) by 379 days.

(21) Appl. No.: 11/528,040

(22) Filed: Sep. 27, 2006

(65) Prior Publication Data

US 2008/0074024 A1 Mar. 27, 2008

(51) Int. Cl.

| | |
|---|---|
| ***H01J 5/16*** | (2006.01) |
| ***H01J 61/40*** | (2006.01) |
| ***H01K 1/26*** | (2006.01) |
| ***H01K 1/30*** | (2006.01) |

(52) U.S. Cl. ..... 313/113; 362/341; 362/347; 362/516; 362/519; 362/346; 313/114; 313/128; 313/578

(58) Field of Classification Search ..... 313/110, 313/111, 113, 114, 116; 362/296–299, 304, 362/308, 346, 516–522, 341, 347
See application file for complete search history.

(56) References Cited

U.S. PATENT DOCUMENTS

| | | | | | |
|---|---|---|---|---|---|
| 4,420,800 | A * | 12/1983 | Van Horn | ..... | 362/297 |
| 4,473,872 | A * | 9/1984 | Puckett et al. | ..... | 362/309 |
| 4,484,254 | A * | 11/1984 | Puckett et al. | ..... | 362/309 |
| 4,494,176 | A * | 1/1985 | Sands et al. | ..... | 362/297 |
| 5,199,787 | A * | 4/1993 | King et al. | ..... | 362/310 |
| 6,086,227 | A * | 7/2000 | O'Connell et al. | ..... | 362/297 |
| 6,168,293 | B1 * | 1/2001 | Lieszkovszky et al. | ..... | 362/297 |
| 6,201,348 | B1 * | 3/2001 | Nortrup et al. | ..... | 313/573 |
| 6,329,742 | B1 * | 12/2001 | Nelson et al. | ..... | 313/25 |
| 7,030,543 | B2 * | 4/2006 | Galvez et al. | ..... | 313/25 |
| 7,125,149 | B2 * | 10/2006 | Kling et al. | ..... | 362/348 |
| 7,131,749 | B2 * | 11/2006 | Wimberly | ..... | 362/297 |
| 7,423,380 | B2 * | 9/2008 | Ota et al. | ..... | 313/638 |
| 2002/0011767 | A1 * | 1/2002 | Zhou et al. | ..... | 313/113 |
| 2005/0018432 | A1 * | 1/2005 | Buschmann et al. | ..... | 362/328 |
| 2005/0212393 | A1 * | 9/2005 | Weyhrauch et al. | ..... | 313/17 |

* cited by examiner

*Primary Examiner*—Sikha Roy
*Assistant Examiner*—Jose M Diaz
(74) *Attorney, Agent, or Firm*—William H. McNeill

(57) ABSTRACT

A compact PAR lamp (10) has a hollow body (12) arrayed along a longitudinal axis (14) and has an open end (16) and a substantially closed neck end (18) and containing a light source capsule (20) within the hollow body (12) and coaxial with the longitudinal axis (14). The light source capsule (20) has electrical lead-ins (22, 24) that extend therefrom and exit via the neck end (18). A first parabolic reflector (26) is formed within the body (12) and has a wide portion (28) adjacent the open end (16) and a narrow portion (30) spaced therefrom along the longitudinal axis (14). A second reflector (32) is formed within the body (12) and extends from the narrow portion (30) into the neck end (18). A lens (34) closes the open (16), and a base (36) is attached to the closed neck end (18). In an alternate version the light source (20) comprises an arc discharge vessel (44) containing electrodes (46, 48) having termini (46', 48') defining an arc gap (50) therebetween and the focal points of the second reflector (when the second reflector is ellipsoidal) correspond with the termini (46', 48').

2 Claims, 3 Drawing Sheets

COMPACT PAR LAMP COMPRISING AN ELLIPSOID REFLECTOR HAVING MORE THAN ONE FOCAL POINT

TECHNICAL FIELD

This invention relates to electric lamps and more particularly to lamps having a parabolic reflector (PAR lamps). Still more particularly, it relates to compact PAR lamps such as those having major diameters of 2.5 inches or less.

BACKGROUND ART

PAR lamps are typically comprised of a light source such as a tungsten halogen capsule or a high intensity discharge (HID) arc tube mounted within a glass body with a parabolic reflector therein. The glass body can be pressed borosilicate glass. A lens usually covers the front or light-emitting end of the body and can contain optical elements to provide a desired beam shape (for example, a spot or flood beam). General service PAR lamps usually have a neck region between the parabolic reflector and the base, and the base generally comprises a threaded fitting for connecting the lamp to a power source via a socket. The usual power source is 100 to 240 volts. The neck provides the mechanical support between the reflector optical portion and the base electrical portion. The neck additionally provides room for the capsule press seal, the lead-ins, capsule mounting components, and wiring and separates the light source (i.e., the filament or arc discharge) from the base to reduce the base temperature.

Much of the light that enters the neck opening of PAR lamps is lost due to multiple reflection and absorption by the mount and capsule components and does not contribute to the beam. It is known that the neck opening cross-sectional area should be as small as possible to maximize beam intensity and lamp efficiency (determined by dividing lamp lumens by source lumens). The marketplace demands compact lamps with small diameter aperture such as PAR 16 and PAR 20 size lamps; however, as lamp diameter and reflector focal length decrease, the light loss in the neck area becomes substantial. Lumen output and center beam candle power (CBCP) fall off rapidly as PAR lamp size decreases and it is very difficult to design a PAR 16 spot lamp with acceptable performance. At this point in time, PAR 16 lamps are available only in a flood beam angle where the light center can be positioned ahead of the focus and away from the neck opening without an unacceptable loss in center beam intensity.

DISCLOSURE OF INVENTION

It is, therefore, an object of the present invention to obviate the disadvantages of the prior art.

It is another object of the invention to enhance compact PAR lamps.

Yet another object of the invention is a compact PAR lamp having a spot beam.

These objects are accomplished, in one aspect of the invention, by a compact PAR lamp comprising: a hollow body arrayed along a longitudinal axis and having an open end and a substantially closed neck end and containing a light source capsule within said hollow body and coaxial with said longitudinal axis, said light source capsule having electrical lead-ins extending therefrom and exiting via said neck end; a first parabolic reflector formed within said body having a wide portion adjacent said open end and a narrow portion spaced therefrom along said longitudinal axis; a second reflector formed within said body and extending from said narrow portion into said neck end; a lens closing said open; and a base attached to said closed neck end. The secondary reflecting surface substantially reduces the amount of light entering the neck region and directs more of the light into the beam.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
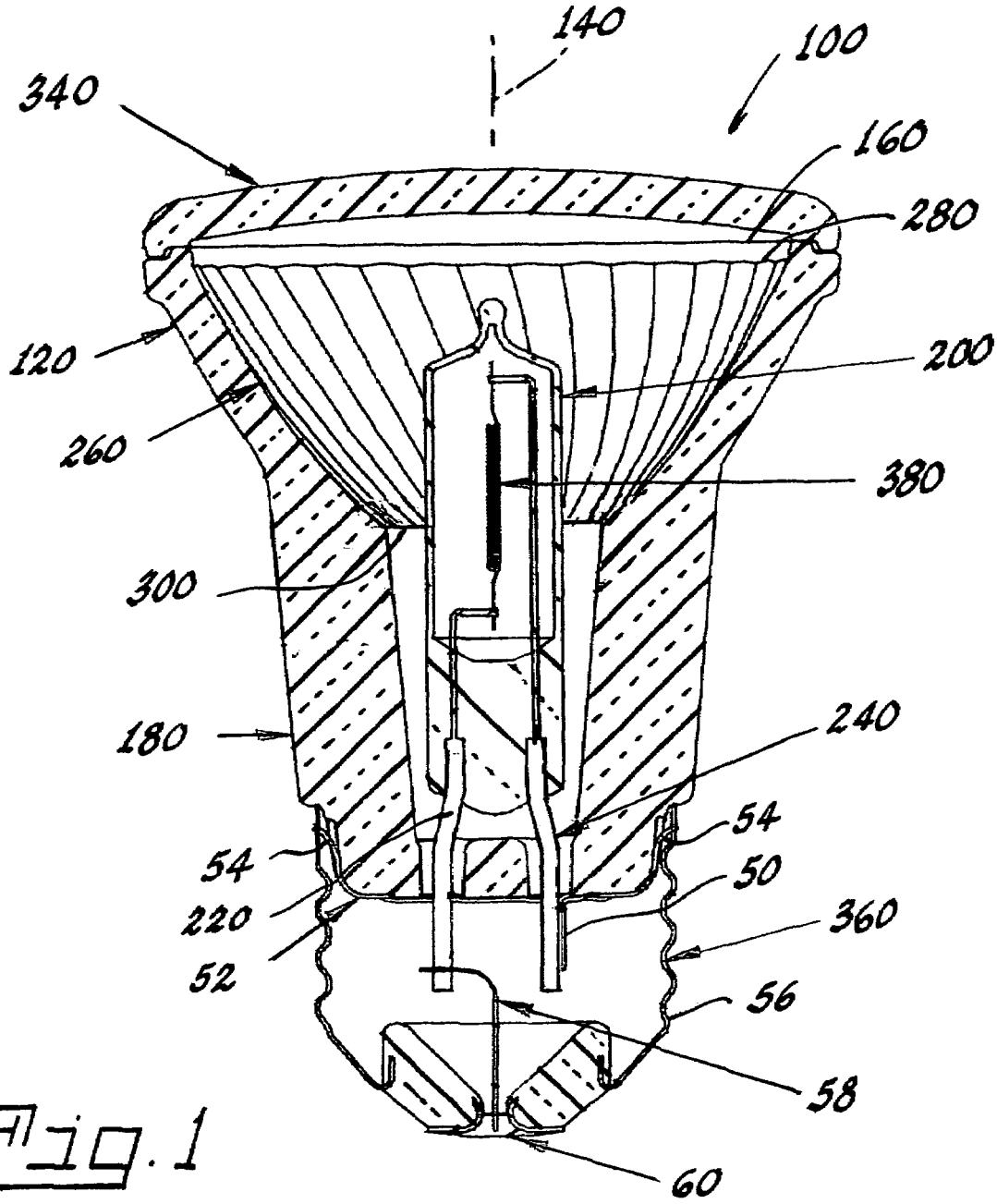
Fig. 1 PRIOR ART
FIG. 1 is an elevational cross section of a prior art lamp.

Referring now to the drawings with greater particularity, there is shown in FIG. 1 a prior art PAR lamp 100 having a body 120 arrayed along a longitudinal axis 140. The body 120 has an open end 160 and a substantially closed neck end 180 and contains a light capsule 200. As shown the light source capsule 200 contains an incandescent filament 380 arrayed along the longitudinal axis 140 and having lead-ins 220 and 240 extending from the capsule 200 for appropriate electrical connection to a base 360. A parabolic reflector 260 having a wide portion 280 and a narrow portion 300 is formed within the body 120 and a lens 340 closes the open end 160.

Lamps of this description are generally available under the designations PAR 16 or PAR 20 depending upon the major diameter of the bulb: however, such lamps have relatively poor efficiency and center beam intensity, especially with the spot beam angle. PAR 16 lamps are typically available only in flood beam angle.

Figure 2:
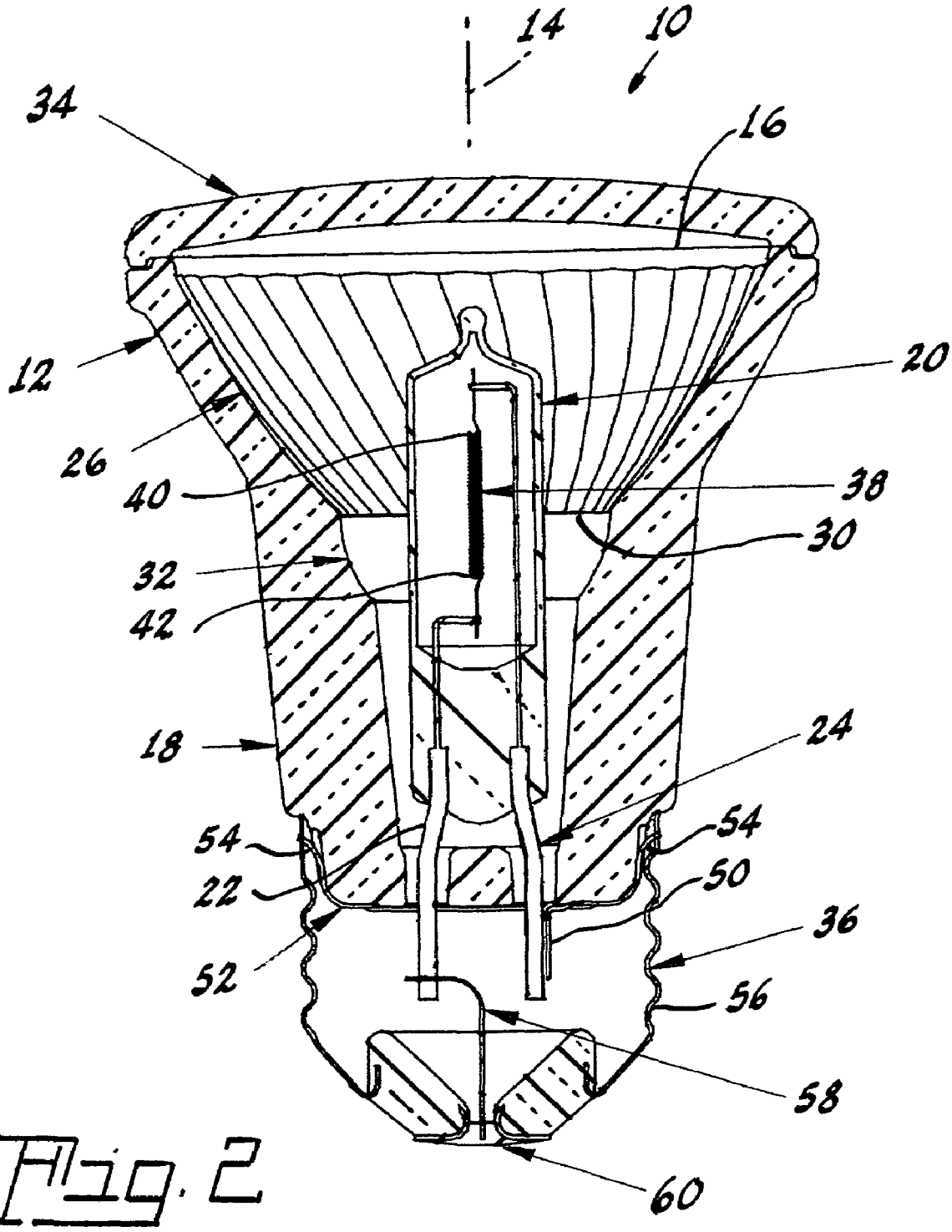
FIG. 2 is an elevational cross section of an embodiment of the invention.

To remedy this problem and provide a compact PAR lamp with an acceptable spot beam the lamp shown in FIG. 2 is provided. Therein, a compact PAR lamp 10 has a hollow body 12 arrayed along a longitudinal axis 14. The body 12 has an open end 16 and a substantially closed neck end 18. A light source capsule 20 is positioned with the body 12 and is coaxial with the axis 14. The capsule 20 in this instance contains an incandescent filament 38 that is arrayed along the longitudinal axis 14 and has a first end 40 and a second end 42. Electrical lead-ins 22, 24 connect the filament and extend from the capsule 20 and exit the body 12 via the neck end 18.

A first parabolic reflector 26 is formed within the hollow body 12 and has a wide portion 28 adjacent the open end 16 and a narrow portion 30 spaced therefrom along the longitudinal axis 14. A second reflector 32 is formed within the body 12 and extends from the narrow portion 30 into the neck end 18. A lens 34 closes the open end 16 and a base 36 is attached to and closes the neck end 18.

In a preferred embodiment of the invention the second reflector 32 is ellipsoidal; however, the second reflector also could be spherical. When the second reflector 32 is ellipsoidal the focus points of the ellipse will coincide with the first and second ends 40, 42 of the filament 38. If the second reflector 32 is spherical, the center point thereof will coincide with or be near the parabolic focal point.

The advantages of the invention will be seen from a comparison of FIGS. 1 and 2. In both instances the center of the filament 38 is positioned at the parabolic focal point. In the prior art lamp of FIG. 1 this positioning mandates that nearly 30% of the filament length is below the neck opening; however, with the version shown in FIG. 2 the entire filament length is well above the neck opening. This second reflector surface additionally provides a transition zone between the thick wall of the neck and the thinner wall of the parabolic reflector. This feature reduces envelope weight and improves manufacturability.

Optical ray trace modeling was used to estimate the effect of adding an elliptical second reflector to a PAR 20 reflector. The modeling predicted a 6% percent lumen increase and a 13% increase in center beam intensity. Additionally, a significant increase in radiated power returned to the coil was predicted and such an increase would further improve lamp efficiency.

In practice the new design incorporated into PAR 20 lamps with operating parameters of 50 W/120V, has been found to provide a 3.4% lumen increase and a 12% increase in center beam intensity, a good agreement with the ray trace mode.

When the new design is incorporated into the smaller PAR 16 lamp, the benefits are even greater, resulting in a measured 12% higher lumen output and 35% greater center beam intensity than prior art lamps with but a single parabolic reflecting surface.

Also, these benefits are achievable with PAR lamps employing arc tubes as the light source.

Figure 3:
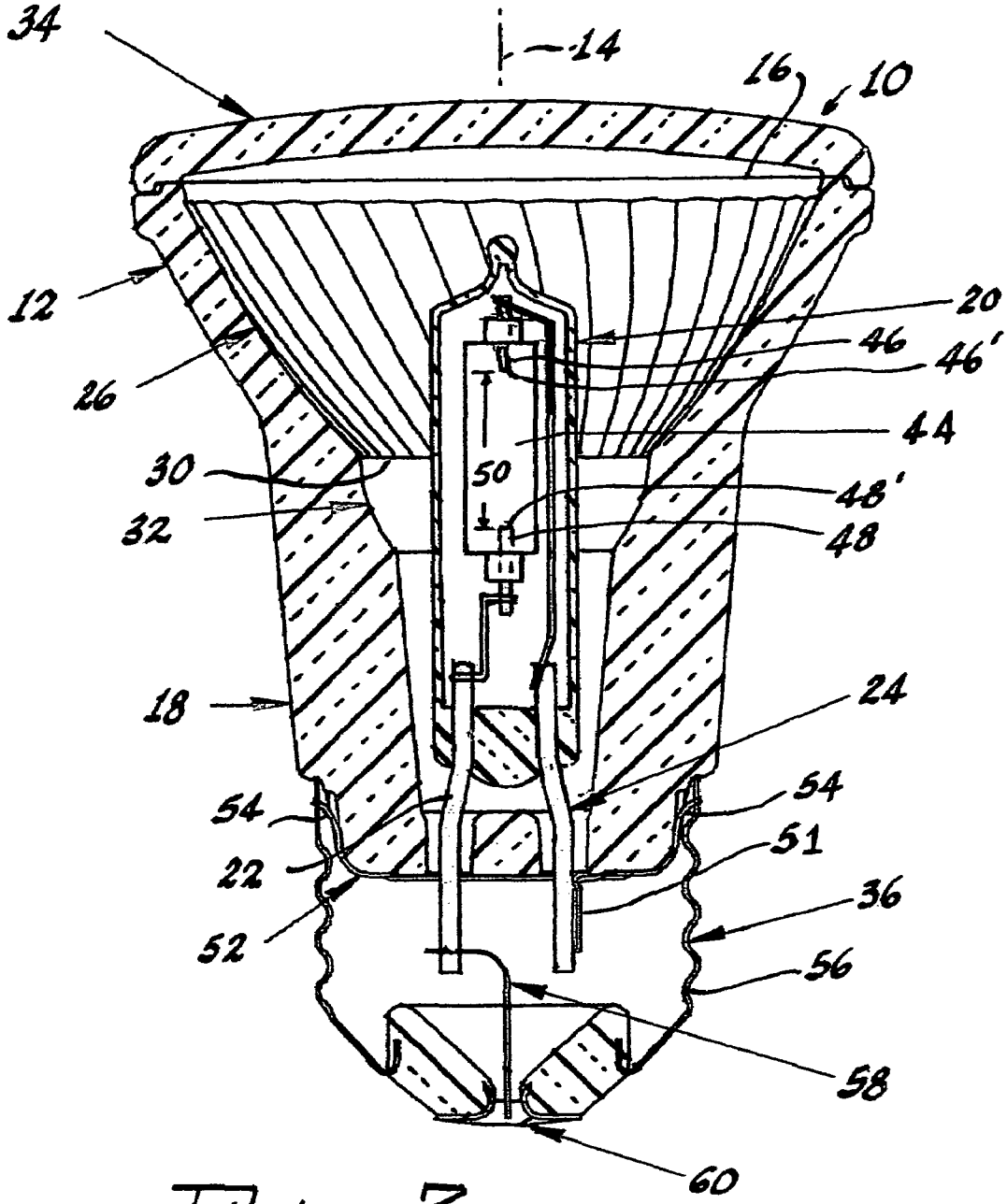
FIG. 3 is a similar view of an alternate embodiment of the invention.

Such an example is shown in FIG. 3, wherein the light source 20 comprises an arc discharge vessel 44 containing electrodes 46, 48 having termini 46', 48' defining an arc gap 50 therebetween and the focal points of the ellipsoid second reflector 32 correspond with the termini 46', 48'. Again, this provides all of the light emission above the neck opening. Further benefits are also provided by this approach since, when but a single reflector surface is used, the arc tube wall temperature can be too cold to achieve optimum vapor pressure of the salts that are used in low wattage metal halide lamps. The surface of the secondary reflector 32 returns additional radiated power to the arc tube 44 that increases wall temperature to raise the vapor pressure. Further, the second reflector 32 directs radiated power away from the seal areas, thus reducing the chance of seal failures.

In the lamps shown herein the capsule 20 is supported by a lead-in (for example, 24) that is welded or otherwise affixed to an inner tab 51 of a metal clip 52. The outer tabs 54 of the clip 52 contact the screw portion 56 of the base 36. One end of a small diameter fuse wire 58 is welded to the other lead-in (22, in this instance) and the other end of the fuse wire 58 is soldered or otherwise affixed to the center eyelet 60.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A compact PAR lamp comprising:

a hollow body arrayed along a longitudinal axis and having an open end and a substantially closed neck end and containing a light source capsule within said hollow body and coaxial with said longitudinal axis, said light source capsule having electrical lead-ins extending therefrom and exiting via said neck end;

a first parabolic reflector formed within said body having a wide portion adjacent said open end and a narrow portion spaced therefrom along said longitudinal axis;

a second reflector formed within said body and extending from said narrow portion into said neck end, said second reflector comprising an ellipsoid having two focal points;

said light source capsule including an incandescent filament arrayed along said longitudinal axis and having a first end and a second end, the focal points of said ellipsoid corresponding with said first end and said second end of said filament;

a lens closing said open end; and a base attached to said closed neck end.

2. A compact PAR lamp comprising:

a hollow body arrayed along a longitudinal axis and having an open end and a substantially closed neck end and containing a light source capsule within said hollow body and coaxial with said longitudinal axis, said light source capsule having electrical lead-ins extending therefrom and exiting via said neck end;

a first parabolic reflector formed within said body having a wide portion adjacent said open end and a narrow portion spaced therefrom along said longitudinal axis:

a second reflector formed within said body and extending from said narrow portion into said neck end, said second reflector comprising an ellipsoid having two focal points;

said light source comprising an are discharge vessel containing electrodes having termini defining an arc gap therebetween and the focal points of said ellipsoid correspond with said termini;

a lens closing said open end; and a base attached to said closed neck end.

* * * * *